United States Patent [19]

Stark et al.

[11] 4,445,691

[45] May 1, 1984

[54] METHOD OF PRODUCING A PUZZLE

[75] Inventors: Martin H. Stark; George V. Pisani, both of Saginaw; James J. Pauquette, Bloomfield Hills, all of Mich.

[73] Assignee: Arrow Paper Products Company, Saginaw, Mich.

[21] Appl. No.: 426,796

[22] Filed: Sep. 29, 1982

[51] Int. Cl.[3] ..... A63F 9/08

[52] U.S. Cl. ..... 273/155

[58] Field of Search ..... 273/153 R, 153 S, 155

[56] References Cited

U.S. PATENT DOCUMENTS 1,209,675 12/1916 Converse ..... 273/153 R 2,931,657 4/1960 Lewis ..... 273/155

*Primary Examiner*—Anton O. Oechsle

*Attorney, Agent, or Firm*—Learman & McCulloch

[57] ABSTRACT

A method of forming a puzzle comprises cutting a sheet having a design thereon into a plurality of parallel strips, cutting some or all of the strips transversely to form multiple pieces, rearranging the pieces of each cut strip end-for-end to form secondary strips, forming each of the strips into an endless ring, and assembling the rings on a spindle for independent rotation about a common axis.

8 Claims, 5 Drawing Figures

METHOD OF PRODUCING A PUZZLE

BACKGROUND OF THE INVENTION

Numerous kinds of puzzles are in existence for the purpose of providing amusement with varying degrees of challenge. Some of the currently popular puzzles employ relatively movable parts which are so colored as to require the user to manipulate the parts in such manner as to locate all correspondingly colored parts adjacent one another. Others utilize rotatable or slideable members bearing numbers or colors or parts of designs which, when the members are arranged in a predetermined order, will display the numbers or colors or design parts in a selected pattern. Some of these latter puzzles are flat, whereas others are cylindrical. Some of the cylindrical puzzles have designs which are visible wholly circumferentially of the cylinder, whereas others have designs which are visible only through slits or slots cut in a covering cylinder.

In the production of a puzzle employing relatively movable, cylindrical members each bearing segments of a design, and wherein the design is intended to be visible about the whole circumference of the cylinder, it is desirable that the solution to the puzzle depend upon proper alignment of the design segments, rather than upon the alignment of mechanical features having nothing at all to do with the design. Accordingly, the principal object of the present invention is to provide a method of producing a puzzle composed of a plurality of rings each of which bears a selected portion or segment of a predetermined design, the rings being independently rotatable to align or register the individual design segments and thus display the whole design. The rings are so constructed that they themselves give no clue to the positions the rings must occupy relative to one another to display the design.

SUMMARY OF THE INVENTION

A puzzle according to the invention is formed from a two-dimensional sheet of material, such as paper, bearing any one of a number of different designs. The sheet is cut horizontally into a plurality of parallel, horizontal strips, following which most or all of the strips are cut transversely into two pieces. The pieces of each strip then are rearranged end-to-end to form second strips.

The rearranged second strips then are joined to one another at their confronting edges and thereafter formed into endless rings and assembled on a spindle for independent rotation. Relative rotation of the rings will enable the segments or portions of the designs on each ring to be aligned or registered in such manner as to reproduce and display the original design.

DESCRIPTION OF THE DRAWINGS

The method according to the invention is illustrated in the accompanying drawings, wherein.

DESCRIPTION OF THE PREFERRED EMBODIMENT

Figure 1:
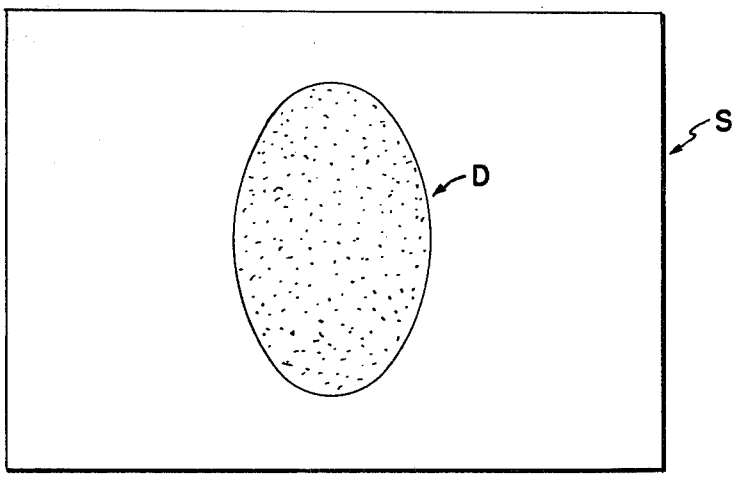
FIG. 1 is a plan view of a sheet of material bearing a selected design.
Figure 2:
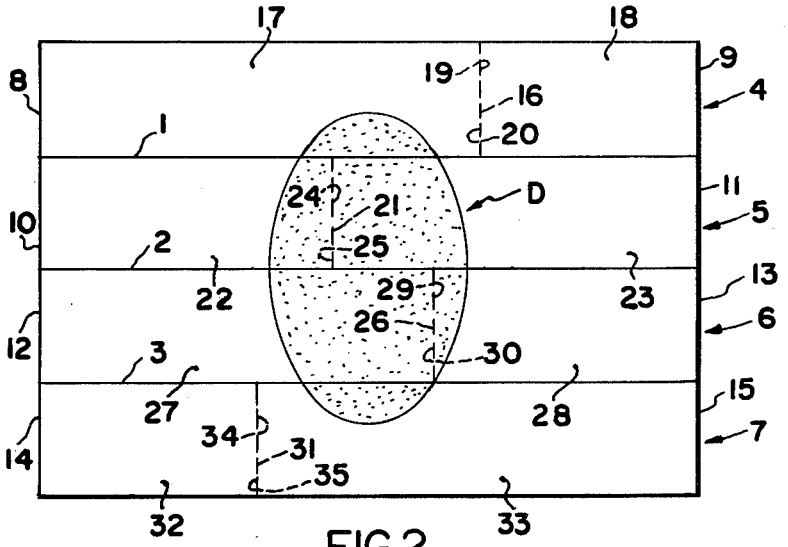
FIG. 2 is a view similar to FIG. 1, but illustrating the sheet cut along horizontal and transverse lines to form parallel strips composed of two pieces each.

A puzzle formed in accordance with the invention commences with the production of a two-dimensional design D on a sheet S of material such as paper, cardboard, plastic, and the like. The design D may be a representation of an object, a landscape, or a portrait, or a series of numbers, a plurality of colored squares, or any other suitable design. For purposes of simplicity in illustrating the method, design D is illustrated as a relatively small oval, but it will be understood that it is preferable for the design to cover the entire surface of the sheet S.

The sheet S is cut horizontally along spaced lines 1, 2, and 3 to form four separate strips 4, 5, 6, and 7. The strip 4 has opposite ends 8 and 9, the strip 5 has opposite ends 10 and 11, the strip 6 has opposite ends 12 and 13, and the strip 7 has opposite ends 14 and 15.

If each of the strips 4–7 were formed into rings by joining the opposite ends 8, 9; 10, 11; 12, 13; and 14, 15, then such joined ends would form a seam which, when aligned vertically, would reproduce the design D. Thus, it would be a simple matter to rotate the rings in such manner as to align the seams and reproduce the design D and the puzzle would present no challenge. According to the invention, therefore, the strips 4–7 are treated in such manner as to frustrate reproduction of the design D by reference to mechanical characteristics such as the aforementioned seams.

According to the invention the strip 4 is cut transversely along the line 16 to form two pieces 17 and 18. The piece 17 thus has ends 8 and 19 and the piece 18 has ends 9 and 20. The strip 5 is similarly cut along a vertical line 21 to form two pieces 22 and 23, the piece 22 having ends 10 and 24 and the piece 23 having ends 11 and 25. The strip 6 similarly is cut along the line 26 to form two pieces 27 and 28, with the piece 27 having ends 12 and 29 and the piece 28 having ends 13 and 26. In like manner, the strip 7 may be cut along the line 31 to form two pieces 32 and 33. The piece 32 has ends 14 and 34 and the piece 33 has ends 15 and 35. It should be understood that not all of the strips 4–7 need be cut into two pieces, but for purposes of illustration each is shown as being cut.

Figure 3:
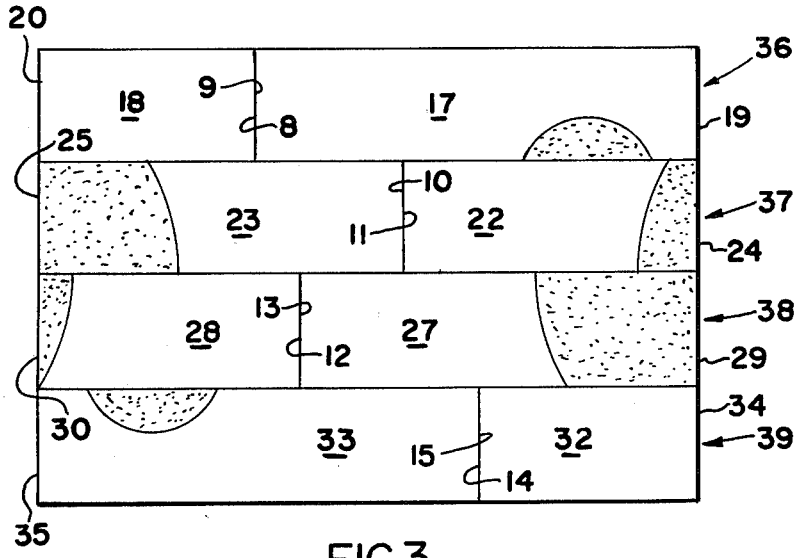
FIG. 3 is a view similar to FIG. 2, but illustrating the individual pieces of each original strip rearranged end-to-end to form modified or second strips.

Following cutting of the strips to form two pieces from each, the pieces of each strip are rearranged end-to-end to form modified or second strips. Thus, the strip 4 is rearranged by having the end 9 of the piece 18 abut the end 8 of the piece 17 and form a modified second strip 36, as is shown in FIG. 3. Similarly, the strips 5, 6, and 7 are rearranged to form modified strips 37, 38, and 39, respectively. The design D thus will be restructered with each of the strips containing some segment of the design.

Following the arrangement of the original strips 4–7 to form the modified or second strips 36–39, the abutting ends of the respective strips may be adhered to one another and each strip formed into an endless ring. Thus, the ends 19 and 20 of the strip 36 may be joined to form a first ring 40 (FIG. 4), the ends 24 and 25 of the strip 37 may be joined to form a ring 41, the ends 29 and 30 of the strip 38 may be joined to form a ring 42, and the ends 34 and 35 of the strip 39 may be joined to form a ring 43. While maintaining the vertical order of the rings 40–43, they then may be placed in encircling relation about a spindle 44 provided at its ends with enlarged caps 45 and 46 which maintain the rings assembled with the spindle 44 and enable relative rotation of the rings about the axis of the spindle.

If the sheet material from which the strips are cut is relatively thin, the strips may be adhered to thicker or stiffer material either prior to or following being formed into rings.

Figure 4:
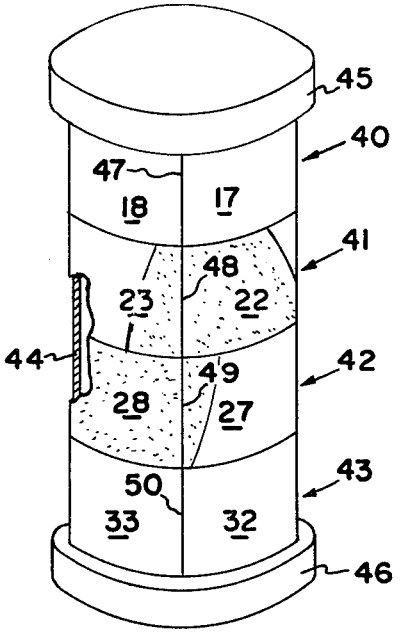
FIG. 4 is an isometric view illustrating the modified strips formed into endless rings and mounted for rotation about a spindle.
Figure 5:
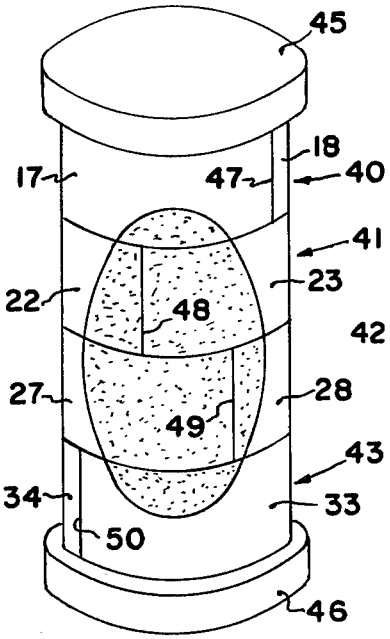
FIG. 5 is a view similar to FIG. 4, but illustrating the rings occupying positions such as to reproduce the original design.

The joining of the ends 19 and 20 of the strip 36 forms a seam 47 (FIG. 4), the joining of the ends 24 and 25 of the strip 37 forms a seam 48, the joining of the ends 29 and 30 of the strip 38 forms a seam 49, and the joining of the ends 34 and 35 of the strip 39 forms a seam 50. Each of these seams is readily visible and may be aligned vertically as is shown in FIG. 4. The vertical alignment of such seams, however, will not result in the reestablishment of the design D. To reestablish the design D following mounting of the rings 40–43 on the spindle 44, each ring must be adjusted relatively to the others until such time as the design segment carried by each ring mates with the design segment of the adjacent ring or rings, as is shown in FIG. 5. In these adjusted positions of the parts the seams 47–50 will not be aligned. Thus, the design can be reproduced only by proper orientation of the rings with reference to the design segments appearing thereon.

Although the puzzle can be produced by the physical joining of each of the pieces of the respective original strips to one another, followed by the forming of the thus modified strips into rings, it is preferred to assemble the rings and pieces in the manner shown in FIG. 3, following which any desired number of reproductions can be made photographically or otherwise. Thereafter, each of the sheets on which the reproduction appears may be cut horizontally along lines corresponding to the cuts 1–3 to form tertiary strips which then are formed into rings and assembled on the spindle 44 in the same manner as has been described earlier.

This disclosure is representative of a presently preferred method of producing a puzzle, but is intended to illustrative of the invention rather than definitive thereof. The invention is defined in the claims.

We claim:

1. A process of producing a puzzle comprising cutting a two-dimensional sheet bearing a selected design into a plurality of parallel strips; cutting each of a selected number of said strips transversely between its ends into at least two pieces; rearranging the pieces of each of said strips end-for-end to form a modified strip; forming each of said modified strips into an endless ring; and mounting each of said endless rings on a spindle for rotation independently of the remainder of said rings.

2. The process according to claim 1 wherein each of said selected strips is cut transversely once only.

3. The process according to claim 1 wherein not all of said strips are cut transversely.

4. The process according to claim 1 including adhering each of said modified strips to material stiffer than that from which such modified strip is formed.

5. A process of producing a puzzle comprising cutting a first sheet bearing a selected two-dimensional design into a plurality of primary, parallel strips; cutting each of a selected number of said primary strips between its ends into at least two pieces; rearranging the pieces of each of said primary strips end-to-end to form secondary strips; reproducing on a second sheet the design presented by said secondary strips; cutting said second sheet to form a plurality of parallel, tertiary strips; forming each of said tertiary strips into an endless ring; and assembling said rings on a spindle for independent rotation about a common axis.

6. The process according to claim 5 wherein each selected one of said primary strips is cut transversely once only.

7. The process according to claim 5 wherein said second sheet is cut along lines corresponding to the lines on which said first sheet was cut to form said primary strips.

8. The process according to claim 5 wherein not all of said primary strips are cut transversely.

* * * * *